US005768656A

United States Patent [19]

Nagasue et al.

[11] Patent Number: 5,768,656

[45] Date of Patent: Jun. 16, 1998

[54] DRIVE TRANSMISSION APPARATUS

[75] Inventors: Ryoichi Nagasue, Kasuga; Yuzo Kawano, Ogori; Kazunori Kanekura, Chikushino, all of Japan

[73] Assignee: Matsushita Electric Industrial Co., Ltd., Osaka, Japan

[21] Appl. No.: 769,379

[22] Filed: Dec. 19, 1996

[30] Foreign Application Priority Data

Dec. 28, 1995 [JP] Japan ..... 7-342791

[51] Int. Cl.[6] ..... G03G 15/00

[52] U.S. Cl. ..... 399/75; 399/167; 74/665 GA; 464/149

[58] Field of Search ..... 399/75, 167, 117; 74/665 GA, 665 K; 464/147, 149, 157

[56] References Cited

U.S. PATENT DOCUMENTS 4,785,362 11/1988 Nozawa et al. ..... 74/665 GA

FOREIGN PATENT DOCUMENTS 4-156473 5/1992 Japan .

*Primary Examiner*—Joan H. Pendegrass

*Attorney, Agent, or Firm*—Stevens, Davis, Miller & Mosher, L.L.P.

[57] ABSTRACT

A drive transmission apparatus includes a first gear for transmitting a driving force to a first rotatable body, a second gear for transmitting the driving force to a second rotatable body and a third gear to which the driving force is transmitted from a driving source, the first, second and third gears being coaxially arranged. A first connecting member passes through the second gear and connects the first gear and the third gear. A cylindrical second connecting member is supported by the first connecting member located inside the second connecting member and connects the second gear and the third gear. The arrangement is such that the fluctuation in rotating speed of the second gear may be transmitted to the first gear through the second connecting member, the third gear and the first connecting member.

22 Claims, 7 Drawing Sheets

DRIVE TRANSMISSION APPARATUS

BACKGROUND OF THE INVENTION

1. Field of the Invention

The present invention relates to a drive transmission apparatus for driving a rotatable body or element such as a photosensitive drum for a copying machine or a printer to which an electrophotographic process is applied and a platen used for a serial printer.

2. Description of the Prior Art

In recent years, an image forming apparatus, which is an output device constructed with an application of an electrophotographic technology, has been put to practical use in a large number of copying machines, plain paper facsimiles and laser printers, and such apparatus has been remarkably developed. Particularly, in the age of multi-media, color printing is required in addition to high resolution, high quality, and high speed printing, and a spread of low-cost image forming apparatuses is required.

An explanation is made below of an image forming apparatus including a conventional drive transmission apparatus with reference to FIGS. 8 to 11.

In FIG. 8, there are shown a printer body 1 which is an image forming apparatus and a paper cassette 2 containing papers 3. The paper 3 is fed by a feed roller 4 from the paper cassette 2 one by one and introduced between a carrying roller 5 and the feed roller 4 to be transmitted to a paper carrying path 6. A manual feed tray 7, on which a paper 8 is fed manually one by one, provides a stable support for allowing the paper 8 to be fed to a manual feed aperture 9; afterward, the paper is put between the carrying roller 5 and the feed roller 4 to be carried in the same manner as the paper 3 in the paper cassette 2. A process unit 10 is made of integrated main components for the image forming apparatus which will be described below and it is so constructed as to be removable from the body.

As shown in FIGS. 9 and 10, a structural member of the process unit 10 comprises an upper frame 10*a* and a lower frame 10*b*. A photosensitive drum 11 is made of polyethylene terephthalate (PET) as a base material with a photosensitive layer such as selenium (Se) and an organic photoconductive member (OPC) coated in a thin layer on its periphery. A gear 11*a* is arranged at an end of the photosensitive drum 11 and rotatably supported by a fixed shaft 11*b* arranged in a lower frame 10*b*. A charger 12 comprises a charged brush 12*a* made of conductive rayon or the like and a charged plate 12*b* which is a metal plate. An exposing optical system 13 for forming a static latent image on a surface of the photosensitive drum 11 projects a laser beam 13*a* obtained after modulating by means of a laser driving circuit image signals entered from an external host computer via an interface to have high intensity or different pulse width. In the case of this laser beam 13*a*, a latent image is formed by irradiation with reciprocating scanning by means of the exposing optical system 13 in a width direction of the photosensitive drum 11.

A developing roller 14, which comprises a developing roller shaft 14*a* and a conductive member 14*b* made of silicon or urethane resin formed on an outer circumferential surface of the developing roller shaft 14*a*, is rotatably supported by a bearing 17 held by the lower frame 10*b* movably in a direction indicated by an arrow A. The bearing 17 is pressed toward the photosensitive drum 11 by a coil spring 18 and therefore the developing roller 14 is brought into contact with the photosensitive drum 11 at a given load.

At an end of the developing roller shaft 14*a*, a gear 20 is arranged via an Oldham's shaft coupling 19. The gear 20 is rotatably supported by a fixed shaft 20*a* mounted in the lower frame 10*b*. The developing roller 14 is brought into contact with the photosensitive drum 11 with the aid of the coil spring 18 and therefore the center position of the developing roller 14 is not fixed to a certain position due to manufacturing or assembling error in a radial direction of the photosensitive drum 11 or the developing roller 14 or an error of a distance between centers of the lower frame 10*b*, and hence it must be compensated by the Oldham's shaft coupling 19.

A developing blade 21 comprises a blade plate 21*a* and a conductive member 21*b* made of silicon at the tip of the blade plate 21*a*. The developing blade 21 is fixed as being sandwiched by a leaf spring 21*d* to a fixed plate 21*c* which is fixed to the lower frame 10*b*, and presses the surface of the developing roller 14 through a toner 22 which is a developer. A supply roller 23, which comprises a supply roller shaft 23*a* and a conductive member 23*b* made of urethane resin or the like formed on its outer circumferential surface, is rotatably supported by the lower frame 10*b* and supplies the toner 22 to the surface of the developing roller 14.

A toner storage section 24 is formed by the lower frame 10*b* to contain the toner 22. An agitator 25 comprises an agitator shaft 25*a* and a blade 25*b*, and is pivotally supported by the lower frame 10*b*. The toner 22 in the toner storage section 24 is supplied onto the developing roller 14 through the agitator 25 and the supply roller 23, frictionally charged in a uniform thin layer by a pressing force of the development blade 21, and carried to the photosensitive drum 11.

In FIG. 11, there are shown gears 26, 27, and 28 driven by a motor 29 arranged in the body 1. After installing the process unit 10, the gear 26 drives the photosensitive drum 11 and the developing roller 14 shown in FIG. 8 by being engaged with the gear 11*a*.

In FIG. 8, a transfer roller 15 comprises a transfer roller shaft 15*a* and a conductive member 15*b* such as urethane resin on its outer circumferential surface, and is rotatably supported by the body 1. A cleaning blade 16 is arranged to remove toner 22 which has not been transferred on the paper 3 and remaining on the photosensitive drum 11.

Since it is necessary to exchange or replace regularly the main components in the process unit 10 such as the photosensitive drum 11, the charger 12, the developing roller 14, and the cleaning blade 16 whose lives are generally shorter than the body 1, they are integrated into the process unit 10 to be exchanged at a time for labor-saving maintenance.

A fixing apparatus 30, which is provided for fixing the transferred toner image, comprises a heating roller 30*a* containing an internal heat source and a pressing roller 30*b*, so as to fix a toner image on the paper 3 due to pressure and heat applied by the heating roller 30*a* and the pressing roller 30*b* which grasp the paper and are rotated. A switching claw 31 switches a delivery direction of the paper 3 on which the toner image is fixed: i.e., the paper is delivered to a face down roller 32 when the claw 31 is in a position indicated by a solid line, and is delivered to a face up roller 33 when the claw 31 is in a position indicated by a dotted line.

An operation of the conventional image forming apparatus having the above construction will be described below. First, as a charging process, a surface of the photosensitive drum 11 is uniformly charged at approx. −700 V by applying a high voltage of −1.2 kV or so to the charger 12 from a high-voltage power supply in the body 1. Next, as an exposing process, the surface of the charged photosensitive drum 11 is irradiated with a laser beam 13*a* according to the image data from the exposing optical system 13, so that charges in the irradiated area are erased and a static latent image is formed. Subsequently, as a developing process, a negative potential of approx. −300 V is applied to the developing roller 14 having toner 22 on its surface applied via the supply roller 23. By previously applying negative charges to the toner 22, the toner 22 is attached only to an area of the drum 11 from which the charges are erased by means of irradiation of the laser beam 13*a*, and the latent image becomes visible as a toner image. After that, in a transfer process, the visible toner image is transferred onto the surface of the paper 3 carried by the feed roller 4 by applying a high voltage of approx. +1 kV to the transfer roller 15. The paper 3 on which the toner image is formed is then subject to a fixing process; i.e., pressed between the heating roller 30*a* and the pressing roller 30*b* which constitute the fixing apparatus 30, whereby the toner image is fixed onto the paper 3. Further, in a cleaning process of the photosensitive drum 11, remaining toner on the photosensitive drum 11 after the transfer process is cleared by the cleaning blade 16. Next, in a charge removing process, charges of the latent image remaining on the photosensitive drum 11 are removed by a destaticizer.

In the conventional image forming apparatus which operates as described above, a fluctuation of a rotation speed of the photosensitive drum 11 leads to a fluctuation of a speed in a subscanning direction for forming a latent image due to an effect of the drive transmission system, causing a minute difference between single line spaces which significantly degrades the image quality.

While driving the developing roller 14 which is the component in the unit 10 subject to the greatest load torque, the maximum load is applied to the gear 20 at the mating portion of the gear 20 operating at the lowest speed. Load on the gear 20 causes flexure of the gear 20 or the fixing shaft 20*a* supporting the gear 20, which leads to a fluctuation of the rotation speed. If the fluctuation is transmitted to the gear 11*a*, the speed of the photosensitive drum 11 is changed and the image quality is lowered. As its countermeasure, conventionally, helical gears are used for the gear 20 and the gear 11*a* or a fluctuation of the rotation speed is restrained by enhancing supporting rigidity of the fixing shafts 20*a* and 11*b* for supporting the gears 20 and 11*a* and the lower frame 10*b* for the fixing shaft 11*b*.

The above conventional construction, however, has a problem that a fluctuation of the speed in the mating portion of the gears 20 and 11*a* is directly transmitted to the photosensitive drum 11 which leads to degradation of the image quality.

SUMMARY OF THE INVENTION

It is an object of the present invention to provide a drive transmission apparatus which reduces a transmitted fluctuation of the rotation speed at low cost with a space-saving structure.

To achieve this object, this invention provides a drive transmission apparatus which comprises a first intermediate gear for transmitting a driving force to a first rotatable body, a second intermediate gear for transmitting the driving force to a second rotatable body, a third intermediate gear to which the driving force is transmitted from a driving source, a connecting member for connecting the first intermediate gear to the third intermediate gear directly, and a connecting member for connecting the second intermediate gear to the third intermediate gear directly. This structure makes longer the driving force transmission path between the first intermediate gear and the second intermediate gear and reduces a fluctuation of the rotation speed transmitted from the first gear to the second gear or from the second gear to the first gear. Thus, the drive transmission apparatus, which can reduce transmission of the fluctuation of rotation speed, is obtainable at a low cost and with the space-saving structure.

DESCRIPTION OF THE PREFERRED EMBODIMENTS

FIGS. 1 to 7 illustrate embodiments of the drive transmission apparatus constructed according to the invention. In these figures, means or elements similar to those of the conventional apparatus shown in FIGS. 8 to 11 are designated by numerals identical with those used in FIGS. 8 to 11. The detailed explanation on such means or elements is eliminated in the following description.

Figure 1:
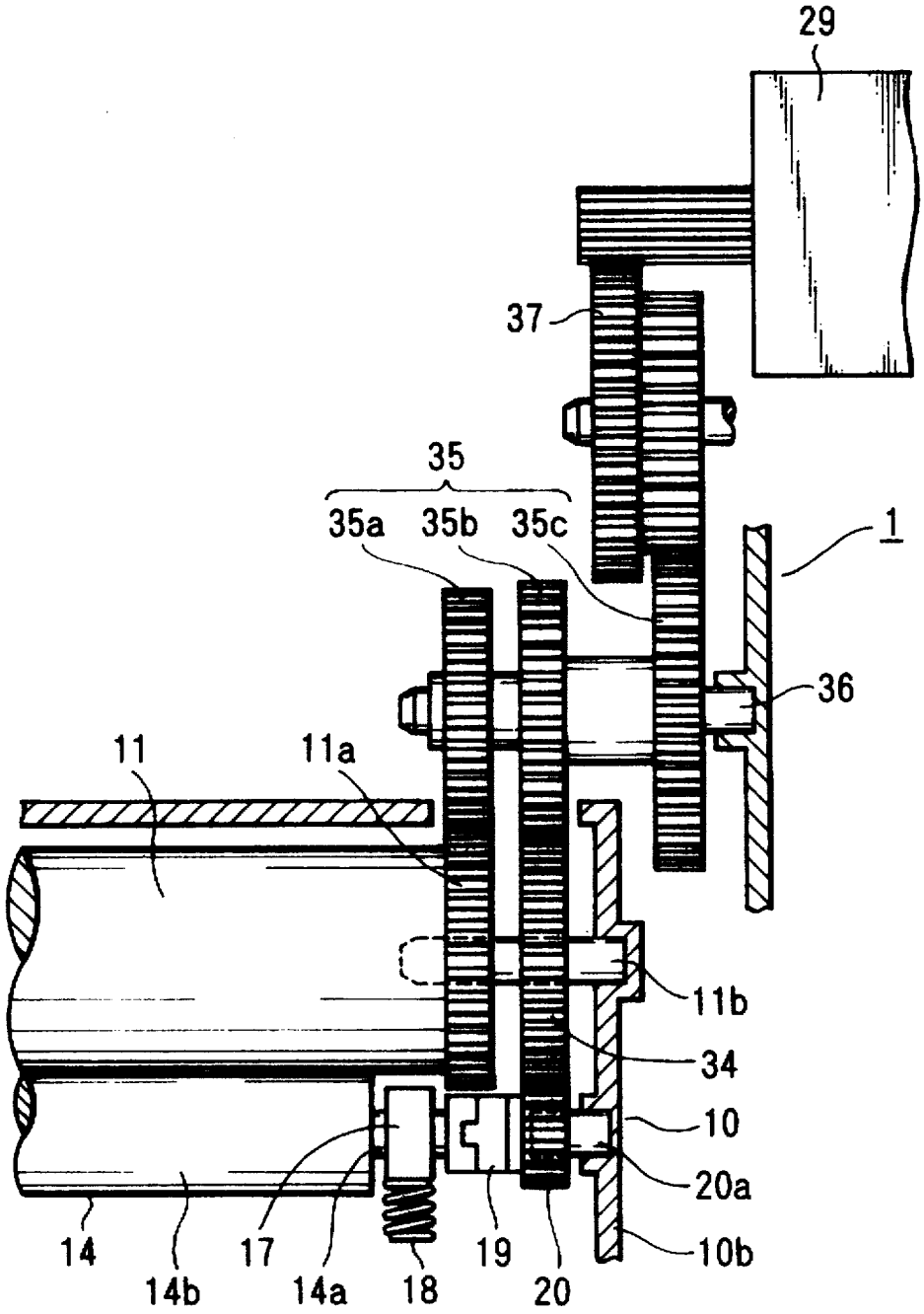
FIG. 1 is a fragmental view showing an image forming apparatus incorporating an embodiment of a drive transmission apparatus constructed according to the invention.

Referring to FIG. 1 which shows an image forming apparatus incorporating an embodiment of a drive transmission apparatus constructed according to the invention, an intermediate gear 34 for driving a gear 20 is rotatably supported by a fixed shaft 11*b* which is arranged coaxially with a photosensitive drum 11 and rotatably supports the drum 11.

The drive transmission apparatus or a gear device 35 is arranged on the side of a body 1 of the image forming apparatus rather than within a process unit 10, and is rotatably supported by a shaft 36 mounted on the body 1. The gearing 35 includes gears 35*a*, 35*b* and 35*c*. A driving force is transmitted from a motor 29, through a gear 37, to the gear 35c. The driving force transmitted to the gear 35c is in turn transmitted to the gears 35a and 35b to rotate the them.

Figure 2:
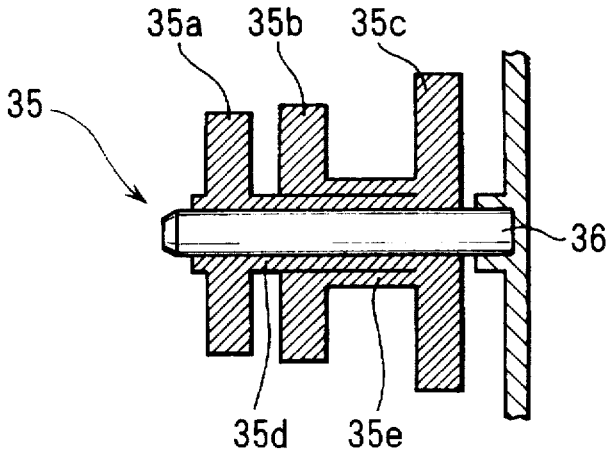
FIG. 2 is a sectional view illustrating the drive transmission apparatus shown in FIG. 1.

As shown in FIG. 2, the gear device 35 includes a cylindrical or sleeve-like connecting member 35d which connects the gear 35a to the gear 35c and a cylindrical or sleeve-like connecting member 35e which connects the gear 35b to the gear 35c. The components such as the gears 35a, 35c and 35c and the connecting members 35d and 35e are integrally connected together to form the gear device 35, and are not separable from each other. Both of the connecting members 35d and 35e are integrally connected at their right ends to the gear 35c, and an inner peripheral surface of the connecting member 35e is supported by an outer peripheral surface of the connecting member 35d in such a manner that the fluctuation in rotation speed of the gear 35b may be transmitted to the gear 35a through the connecting member 35e, the gear 35c and the connecting member 35d. It is to be understood that the inner peripheral surface of the connecting member 35e is supported by but is not connected to the outer peripheral surface of the connecting member 35d.

The drive transmission apparatus having the above-described construction operates as follows:

When a driving force is transmitted from the motor 29 to the gear 35c through the gear 37, the gear 35c is rotated and hence the gears 35a and 35b are also rotated. The rotation of the gears 35a and 35b causes the rotation of a gear 11a and the intermediate gear 34, and the rotation of the gear 34 causes the rotation of the gear 20. Thus, the photosensitive drum 11 and the developing roller 14 are rotated. During such operation, the fluctuation of speed caused between the gears 20 and 34 is first transmitted to the gear 35b, and in turn transmitted to the gear 35a through the connecting member 35e, the gear 35c and the connecting member 35d. The drive force transmission path between the gear 20 and the photosensitive drum 11 thus becomes longer, so that the fluctuation in rotation speed transmitted from the gear 20 to the drum 11 may be reduced.

Figure 3:
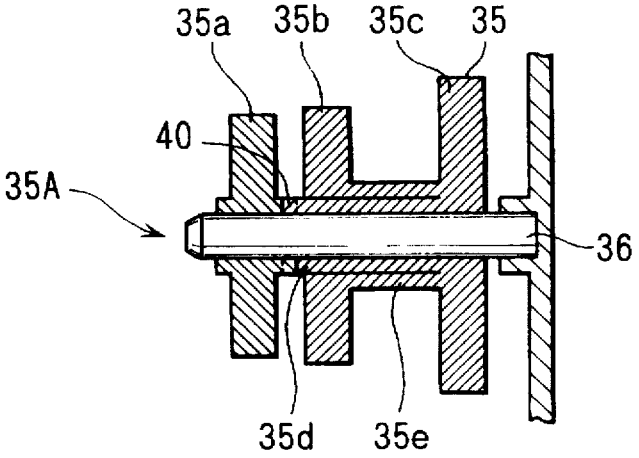
FIG. 3 is a sectional view similar to FIG. 2, illustrating another embodiment of the drive transmission apparatus according to the invention.
Figure 4:
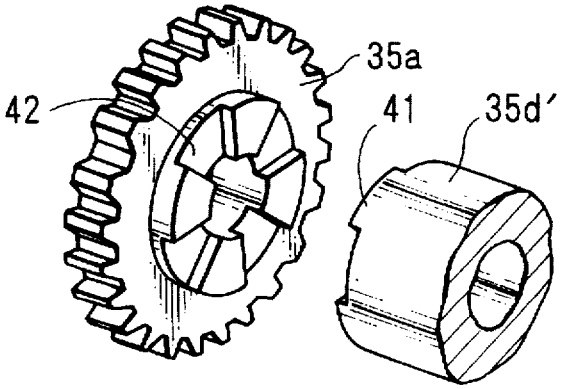
FIG. 4 is a perspective view illustrating an example of a construction of a separable portion of a cylindrical connecting member shown in FIG. 3.

FIGS. 3 and 4 show another embodiment of the gear device. In the gear device 35A shown in these figures, the cylindrical connecting member 35d includes a separable portion 40. As shown in FIG. 4, the separable portion 40 includes a plurality of claws 41 detachably engageable with the complementary notches 42 formed in the gear 35a. Thus, the gears 35a and 35c may be connected to each other through the connecting member 35d by bringing the claws 41 into engagement with the notches 42. Further, the gears 35a and 35c may be disconnected from each other by bringing the claws 41 out of engagement with the notches 42. Since the gear device 35A is formed of two separable components, may be preferably or efficiently produced by molding the respective components, which enhances productivity of the device.

Figure 5:
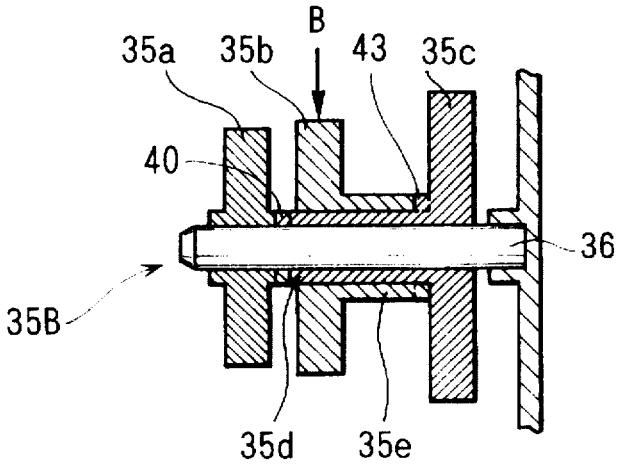
FIG. 5 is a sectional view similar to FIG. 2, illustrating a further embodiment of the drive transmission apparatus according to the invention.

FIG. 5 shows another embodiment of the gear device. In the gear device 35B shown in FIG. 5, the cylindrical connecting member 35d includes a separable portion 40 as similar to the gear device 35A shown in FIGS. 3 and 4. In the case of the gear device 35B, however, also the connecting member 35e includes a separable portion 43. The structure of the separable portion 43 may be similar to the structure of the separable portion 40. That is, the separable portion 43 may include claws at an end of the connecting member 35e which are similar to the claws 41, and notches formed in the gear 35c which are similar to the notches 42. The separable portion 43 enables the gears 35b and 35c to be disconnected from each other. As will be understood, with the structure of the gear device 35B which is formed of three separable components, productivity of the device may be further enhanced.

During operation of the gear device, a force is applied to the gear 35b in a direction indicated by an arrow B due to force acting to separate the intermediate gear 34 from the gear 35b. Thus, the fluctuation in rotation speed of the gear 35b may be directly transmitted to the connecting member 35d through frictional force between the gear 35b and the connecting member 35d.

Figure 6:
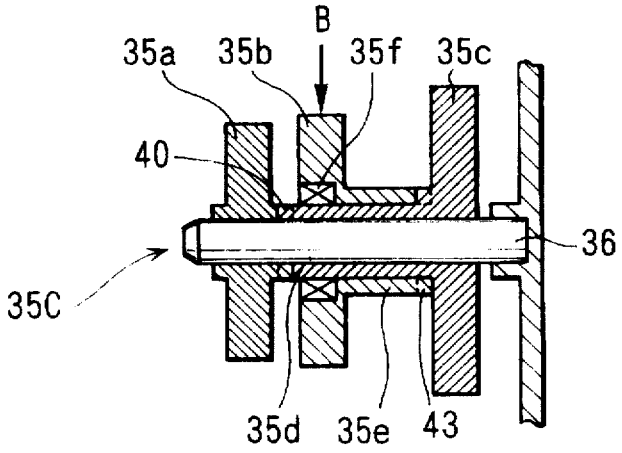
FIG. 6 is a sectional view similar to FIG. 2, illustrating a still further embodiment of the drive transmission apparatus according to the invention.

FIG. 6 shows a further embodiment of the gear device which copes with such problem. With the structure of the gear device 35C shown in FIG. 6, a low-friction bearing 35f is incorporated between the gear 35b and the connecting member 35d so as to reduce the frictional force therebetween, thereby reducing fluctuation in rotation speed directly transmitted from the gear 35b to the connecting member 35d and hence reducing the fluctuation in rotation speed transmitted to the gear 35a. The bearing 35f may be a rolling bearing such as a ball bearing. Further, it is possible to reduce the fluctuation in speed transmitted from the gear 35c to the gear 35a by increasing a coefficient of friction between the connecting member 35d and the shaft 36: e.g., by enhancing roughness of an inner peripheral surface of the connecting member 35d and/or an outer peripheral surface of the shaft 36.

Figure 7:
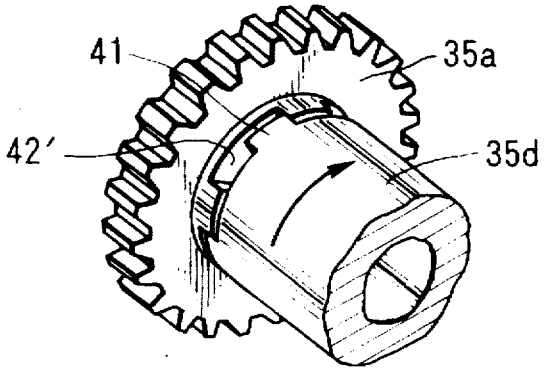
FIG. 7 is a perspective view similar to FIG. 4, illustrating a modified construction of the separable portion.
Figure 8:
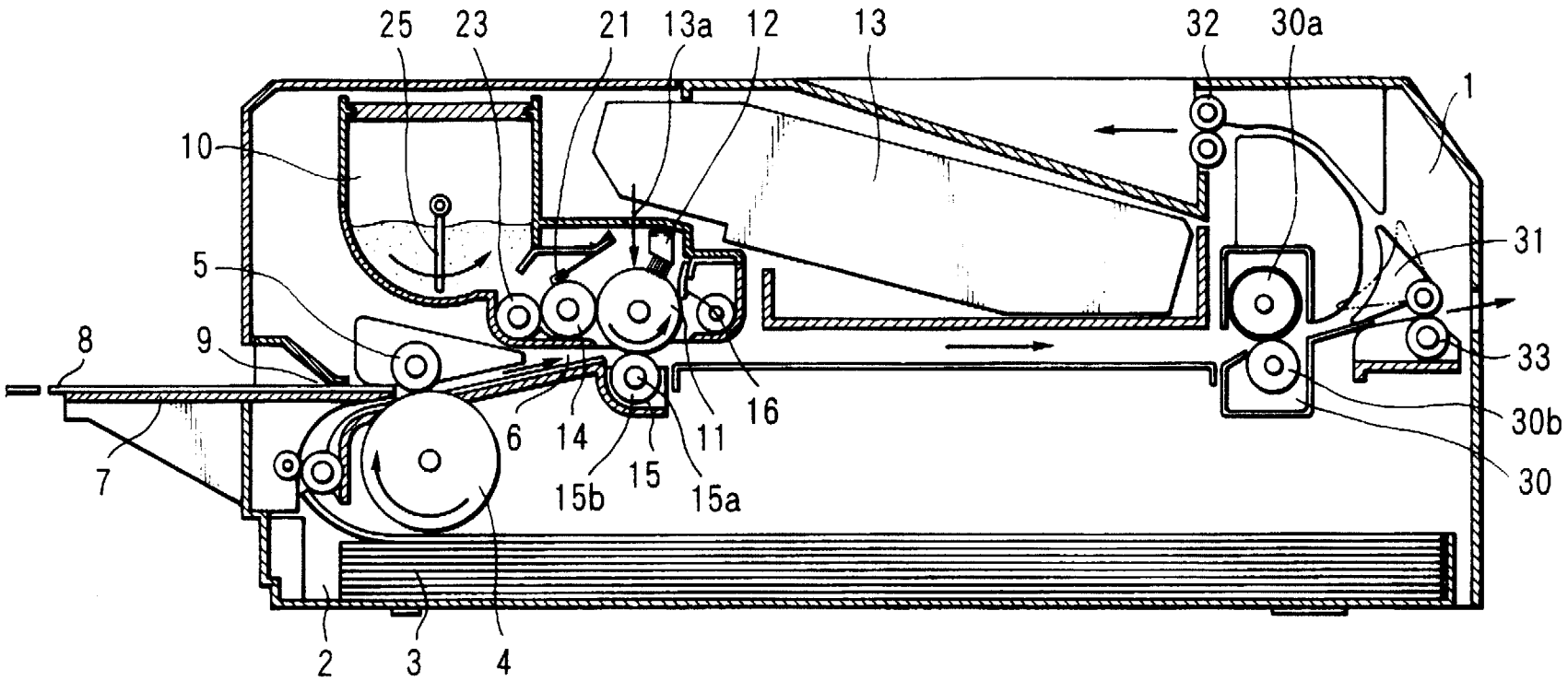
FIG. 8 PRIOR ART
FIG. 8 is a sectional side view showing an image forming apparatus incorporating a conventional drive transmission apparatus.
Figure 9:
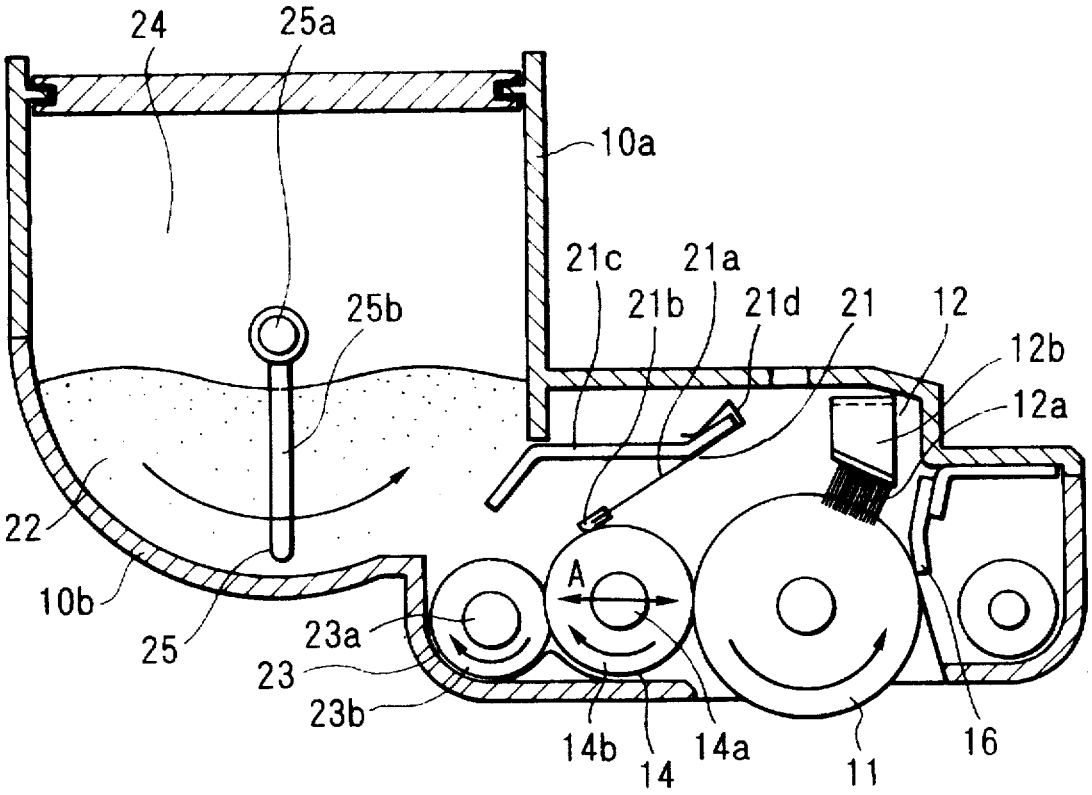
FIG. 9 PRIOR ART
FIG. 9 is an enlarged sectional view of a process unit shown in FIG. 8.
Figure 10:
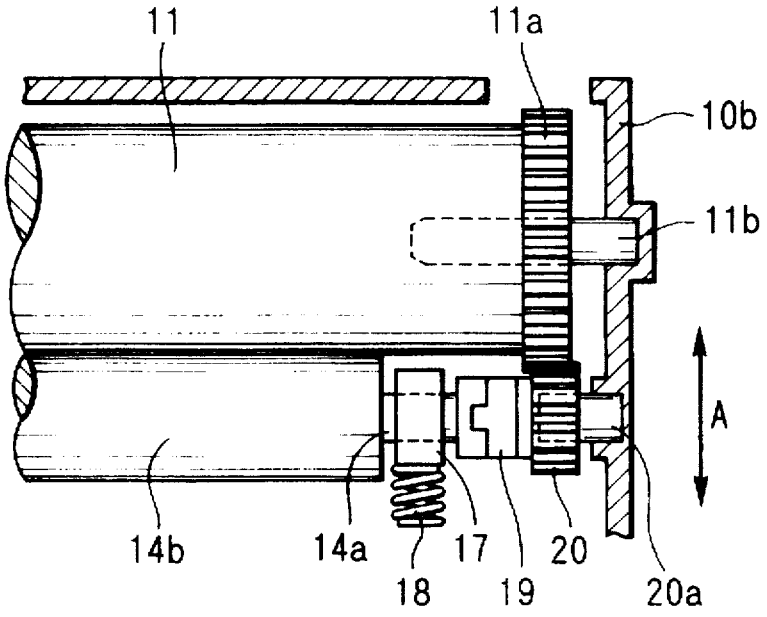
FIG. 10 PRIOR ART
FIG. 10 is a sectional lateral view showing a drive force transmitting mechanism between a photosensitive drum and a developing roller contained in the process unit shown in FIG. 9.
Figure 11:
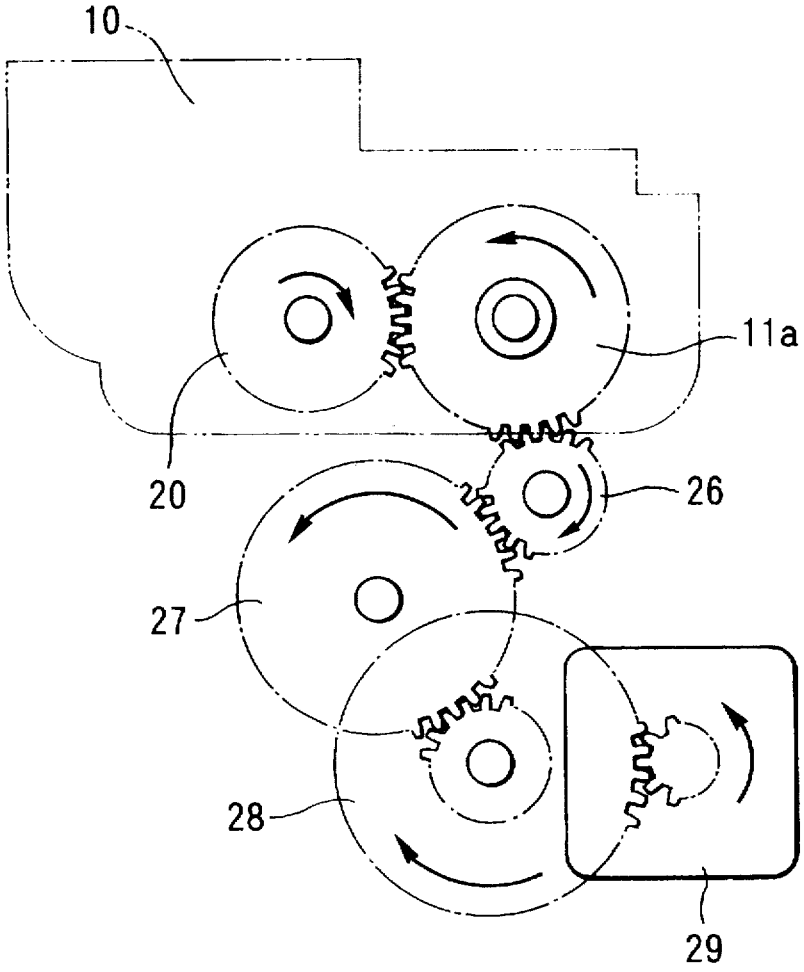
FIG. 11 PRIOR ART
FIG. 11 is an explanative front view showing a drive force transmitting mechanism between a drive motor disposed in a body of the image forming apparatus shown in FIG. 8 and the photosensitive drum and the developing roller.

The structure of the separable portion 40 shown in FIG. 4 may be modified as shown in FIG. 7. In the structure of FIG. 7, the widths of the notches 42' are larger than the widths of the claws 41, so that the connecting member 35d is movable in a rotating direction relative to the gear 35a by a predetermined angle. With such structure, it is possible to easily bring the gears 35a and 35b into engagement with the gears 11a and 34 during installation of the process unit 10 in the body 1 of the image forming apparatus. The separable portion 43 may have the structure similar to the structure shown in FIG. 7.

As will be apparent from the foregoing, a drive transmission apparatus constructed according to the invention reduces the transmission of the fluctuation in rotation speed with the low cost and space-saving structure.

In the case where the drive transmission apparatus is incorporated in the image forming apparatus, the fluctuation in rotation speed transmitted from the developing apparatus to the photosensitive body may be reduced. Consequently, a high resolution and a high quality of images may be achieved. Further, a process unit may be readily removed or dismounted from the body of the image forming apparatus incorporating the drive transmission apparatus constructed according to the invention.

What is claimed is:

1. An image forming apparatus including a drive transmission apparatus comprising a first intermediate gear for transmitting a driving force to a first rotatable body, a second intermediate gear for transmitting the driving force to a second rotatable body, a third intermediate gear to which the driving force is transmitted from a driving source, a connecting member for directly connecting said first intermediate gear to said third intermediate gear, and a connecting member for directly connecting said second intermediate gear to said third intermediate gear, wherein said first rotatable body is a photosensitive body and said second rotatable body is a developing roller.

2. An image forming apparatus including a drive transmission apparatus comprising a first intermediate gear for transmitting a driving force to a first rotatable body, a second intermediate gear for transmitting the driving force to a second rotatable body, a third intermediate gear to which the driving force is transmitted from a driving source, a connecting member for directly connecting said first intermediate gear to said third intermediate gear, and a connecting member for directly connecting said second intermediate gear to said third intermediate gear, wherein said first rotatable body is a developing roller and said second rotatable body is a photosensitive body.

3. A drive transmission apparatus comprising: a first intermediate gear for transmitting a driving force to a first rotatable body, a second intermediate gear for transmitting the driving force to a second rotatable body, a third intermediate gear to which the driving force is transmitted from a driving source, said first, second and third intermediate gears being coaxially arranged in this order, a first connecting member passing through said second intermediate gear and connecting said first intermediate gear and said third intermediate gear for transmitting the driving force from said third intermediate gear to said first intermediate gear, and a cylindrical second connecting member for connecting said third intermediate gear and said second intermediate gear for transmitting the driving force from said third intermediate gear to said second intermediate gear, said first connecting member being located inside said cylindrical second connecting member.

4. A drive transmission apparatus as defined in claim 3, wherein said first connecting member includes a first separable portion which permits said third and said first intermediate gears to be disconnected from each other.

5. A drive transmission apparatus as defined in claim 4, wherein said second connecting member includes a second separable portion which permits said third and said second intermediate gears to be disconnected from each other.

6. An image forming apparatus including the drive transmission apparatus as defined in claim 5, wherein said first rotatable body is a photosensitive body and said second rotatable body is a developing roller.

7. An image forming apparatus including the drive transmission apparatus as defined in claim 5, wherein said first rotatable body is a developing roller and said second rotatable body is a photosensitive body.

8. A drive transmission apparatus as defined in claim 5, wherein said first and said second rotatable bodies are removably arranged, said first separable portion is so constructed as to permit the components connected through said first separable section to move relative to each other in a rotating direction by a predetermined angle, and said second separable section is so constructed as to permit the components connected through said second separable section to move relative to each other in a rotating direction by a predetermined angle.

9. An image forming apparatus including the drive transmission apparatus as defined in claim 4, wherein said first rotatable body is a photosensitive body and said second rotatable body is a developing roller.

10. An image forming apparatus including the drive transmission apparatus as defined in claim 4, wherein said first rotatable body is a developing roller and said second rotatable body is a photosensitive body.

11. A drive transmission apparatus as defined in claim 3, further comprising a bearing member mounted between said second intermediate gear and said first connecting member, said bearing member exhibiting a frictional resistance smaller than frictional resistances of said second intermediate gear and said first connecting member.

12. A drive transmission apparatus as defined in claim 11, wherein said bearing member is a rolling bearing.

13. An image forming apparatus including the drive transmission apparatus as defined in claim 12, wherein said first rotatable body is a photosensitive body and said second rotatable body is a developing roller.

14. An image forming apparatus including the drive transmission apparatus as defined in claim 12, wherein said first rotatable body is a developing roller and said second rotatable body is a photosensitive body.

15. A drive transmission apparatus as defined in claim 11, wherein said first connecting member is formed of a cylindrical member and rotatably supported by a support shaft, a coefficient of friction between said first connecting member and said support shaft being higher than a coefficient of friction between said first connecting member and said second connecting member.

16. An image forming apparatus including the drive transmission apparatus as defined in claim 11, wherein said first rotatable body is a photosensitive body and said second rotatable body is a developing roller.

17. An image forming apparatus including the drive transmission apparatus as defined in claim 11, wherein said first rotatable body is a developing roller and said second rotatable body is a photosensitive body.

18. A drive transmission apparatus as defined in claim 3, wherein said first connecting member is formed of a cylindrical member and rotatably supported by a support shaft, a coefficient of friction between said first connecting member and said support shaft being higher than a coefficient of friction between said first connecting member and said second connecting member.

19. An image forming apparatus including the drive transmission apparatus as defined in claim 18, wherein said first rotatable body is a photosensitive body and said second rotatable body is a developing roller.

20. An image forming apparatus including the drive transmission apparatus as defined in claim 18, wherein said first rotatable body is a developing roller and said second rotatable body is a photosensitive body.

21. An image forming apparatus including the drive transmission apparatus as defined in claim 3, wherein said first rotatable body is a photosensitive body and said second rotatable body is a developing roller.

22. An image forming apparatus including the drive transmission apparatus as defined in claim 3, wherein said first rotatable body is a developing roller and said second rotatable body is a photosensitive body.

* * * * *